US007267735B2

(12) United States Patent
Chang

(10) Patent No.: US 7,267,735 B2
(45) Date of Patent: Sep. 11, 2007

(54) PREFAB-TYPE WATERPROOFING STRUCTURE AND METHOD FOR FABRICATING THE WATERPROOFING STRUCTURE

(75) Inventor: Sung Joo Chang, No. 1008-304, Mokdong Apartment, Sinjeong 1-dong 311, Yangcheon-gu, Seoul (KR) 158-765

(73) Assignees: Sung Joo Chang, Yangcheon-gu (KR); Space Co., Ltd., Kyunggi-do (KR)

( * ) Notice: Subject to any disclaimer, the term of this patent is extended or adjusted under 35 U.S.C. 154(b) by 51 days.

(21) Appl. No.: 11/030,293

(22) Filed: Jan. 7, 2005

(65) Prior Publication Data

US 2005/0153093 A1 Jul. 14, 2005

(30) Foreign Application Priority Data

Jan. 9, 2004 (KR) ..... 10-2004-0001763
Aug. 20, 2004 (KR) ..... 10-2004-0065732

(51) Int. Cl.
*B04F 13/07* (2006.01)
*B04F 13/072* (2006.01)
*B04F 13/077* (2006.01)
*B29C 65/50* (2006.01)
*B32B 37/00* (2006.01)

(52) U.S. Cl. ..... 156/71; 156/297; 156/304.3

(58) Field of Classification Search ..... 156/71, 156/297, 304.1, 304.3; 52/90.1, 302.1, 408–413, 52/745.02, 746.11, 745.11
See application file for complete search history.

(56) References Cited

U.S. PATENT DOCUMENTS 3,468,086 A * 9/1969 Warner ..... 52/173.1
3,900,102 A * 8/1975 Hurst ..... 206/411
4,063,395 A * 12/1977 Stewart et al. ..... 52/309.5
4,416,940 A * 11/1983 Loye et al. ..... 428/324
5,394,672 A * 3/1995 Seem ..... 52/794.1
5,979,133 A * 11/1999 Funkhouser ..... 52/408

FOREIGN PATENT DOCUMENTS

CN 2482579 Y 3/2002
CN 2556020 Y 6/2003

(Continued)

OTHER PUBLICATIONS

English Abstract of JP 10-18524.*

(Continued)

*Primary Examiner*—Chris Fiorilla
*Assistant Examiner*—Sing P. Chan
(74) *Attorney, Agent, or Firm*—Bacon & Thomas, PLLC

(57) ABSTRACT

Disclosed is a prefab waterproof structure and method for fabricating the waterproof structure according to a dry process. The prefab waterproof structure comprises a base sheet layer including a plurality of base sheets, a hard sheet layer including a plurality of hard sheets, and a cover sheet layer including a plurality of cover sheets. The base sheet layer, the hard sheet layer and the cover sheet layer are spread in order on the base surface of concrete. And the sheet layers may be formed by arranging and binding the pre-made sheets. The present invention can improve durability, toughness, chemical resistance, etc significantly, shorten a work period by omitting a hardening process and resolve many environmental problems.

5 Claims, 3 Drawing Sheets

FOREIGN PATENT DOCUMENTS

| | | | | |
|---|---|---|---|---|
| CN | 1443907 | A | | 9/2003 |
| CN | 1458354 | A | | 11/2003 |
| JP | 28-846 | | | 1/1928 |
| JP | 63-013824 | | | 1/1988 |
| JP | 10018524 | A | * | 1/1998 |
| JP | 11310999 | | | 11/1999 |
| JP | 2001-311262 | | | 11/2001 |
| KR | 10 2000 0074322 | A | | 12/2000 |
| KR | 10 2002 0085416 | A | | 11/2002 |
| KR | 10 2003 0066214 | A | | 8/2003 |

OTHER PUBLICATIONS

English Machine Translation of JP 10-18524.*

* cited by examiner

PREFAB-TYPE WATERPROOFING STRUCTURE AND METHOD FOR FABRICATING THE WATERPROOFING STRUCTURE

CROSS REFERENCE OF RELATED APPLICATIONS

This application claims priority under 35 U.S.C. § 119 to Korean Patent Application No. 2004-1763 filed on Jan. 9, 2004 and Korean Patent Application No. 2004-65732 filed on Aug. 20, 2004, the contents of which are incorporated herein by reference in their entireties.

BACKGOUND OF THE INVENTION

1. Field of the Invention

The present invention relates to waterproofing a building structure, and more particularly, to a prefab waterproof structure and method for fabricating the waterproof structure not requiring a field-mixing process or a long time hardening process.

2. Description of the Related Art

Waterproofing a building structure means a method for preventing permeation of rainwater and for treating permeated rainwater. Waterproofing a building structure includes waterproofing for the entire roof surface or wall surface of a building structure in a comprehensive meaning, however, generally indicates treatment for regions easy to be permeated by rainwater such as eaves, aggregate, parapets or railings standing places, ceilings, doors, window frames, etc.

With remarkable development in the field of construction industry, there are under way large-scale constructions such as expressways, rapid-transit railways, high-rise buildings, international airports, super stadiums, etc. However, in many cases, a lot of structures built during economic growth still need repair/reinforcement even before proving their merits. Although repair/reinforcement costs more money than initial construction costs, perfect repair is difficult. Accordingly, it causes a huge amount of loss in the respect that repetitive repairs are required due to recurrence of water leakage.

Especially, since rainwater may permeate rooftop surface, roof surface, and wall surface intensively, these regions should be specially waterproofed. A rooftop of a concrete structure is under the worst surroundings such as direct exposal to the external environments. Accordingly, although there are currently various waterproof materials, actual waterproof materials applicable to the rooftop are confined to small portions thereof. Also, waterproof efficiency is determined according to conditions of base surface layers and factors of the external environments as well as characteristics of waterproof materials. For example, if a base surface of a building structure has high moisture content, waterproof agents are attached over a base surface layer, which may cause bad effects on display of material efficiency. Furthermore, there is formed an air pocket between waterproof materials and the base surface layer due to the vapor pressure evaporating after construction, whereby a waterproof layer may be torn or revered.

Repair/reinforcement may be required after waterproof work, which may be caused by problems of a base surface structure, a waterproof material, a constructor's skill, and a bad design.

As a problem of a base surface structure, there may be cracks resulted from shrinking or expanding of structures. Further, if a base surface layer is not completely dried, moisture remains therein and remaining water is converted into the state of vapor, whereby a waterproof layer may be partially blistered and a fatigued region may be destroyed. If there is any behavior by raising a shrinking/expanding rate of concrete due to temperature, this may cause cracks between a parapet and a rooftop slab.

As a problem of waterproof materials, there may be defects in a waterproof work. In case a waterproof layer has a weak crack resistance against cracks of a base surface of a building structure, or, in case materials are weak against blistering or fatigue, there may be frequent defects in a waterproof work. For example, in case of an oil material, if insulation of a waterproof layer is not secured, durability or weatherability may be deteriorated.

Furthermore, the existing waterproof work highly relies on a constructor. In case of waterproof coating, if not exactly observing mixing rate among materials, or, not giving enough hardening time, it may cause a faulty waterproof work.

Especially, constructors should recognize importance of a waterproof work and then perform precise construction. However, they are not well-aware about construction quality and there is great concern about faulty construction. Furthermore, since an actual low unit cost for waterproof work makes it difficult to get high quality equipments and skilled man power, it is not easy to solve the problem of faulty construction in a waterproof work.

Furthermore, even in the step of a design, if not considering environmental conditions required for regions to be waterproofed, neglecting management of materials, or omitting detailed designs such as locations of drains, joints, etc, there may be defects in a waterproof work.

Furthermore, with development of greening industry cultivating a garden on a rooftop, there is an increasing interest about waterproofing a roof or a rooftop. The rooftop has important meanings such as for example, view from the upper side, air purification in an ecological aspect, noise absorption and decrease of radiant heat, prevention of urban heat island effects, etc. Accordingly, it is a tendency that a greening system is being developed positively for rooftop space left by lack of understanding.

In this rooftop greening system, a waterproof layer is wrapping the external building structure forming a lower part of a greening system. Therefore, although there is no problem in a planting layer and a planting base forming an upper part constituent element, if the waterproof layer does not prevent water leakage, this may cause a big problem that the garden should be remade from the start.

SUMMARY OF THE INVENTION

In order to solve the aforementioned problems, the present invention provides a waterproof structure and waterproof method which can improve durability of a building structure.

The present invention also provides a waterproof structure and waterproof method which can complete a waterproof work promptly without requiring hardening time by using a dry process.

The present invention also provides an environment affinitive waterproof structure and waterproof method which is capable of using recycling waste materials and industrial by-products.

The present invention also provides a waterproof structure and waterproof method which even a general operator with concise instructions and know-how can complete a high quality waterproof work without any defect, not relying on the skills of a constructor.

Since the present invention is conceived to solve all the problems such as water leakage, inefficiency of an operation, etc, that are found in a conventional waterproof structure and waterproof method used in a rooftop greening system, the present invention also provides an entire dry waterproof structure and waterproof method which can prevent water leakage caused by cracks resulted from behavior of a rooftop floor formed of a concrete slab and which can prevent water leakage that is causable in the waterproof layer by planting thereon.

According to one embodiment of the present invention for achieving the aforementioned objects, a prefab waterproof structure comprises a base sheet layer including a plurality of base sheets spread on a base surface of a building structure, a hard sheet layer including a plurality of hard sheets, and a cover sheet layer including a plurality of cover sheets. The base sheet layer, the hard sheet layer, and the cover sheet layer may be overlaid in order to form a triple or multiple structure. Alternatively, the sheets of the sheet layers may be regularly arranged to form a waterproof or protective membrane respectively.

In the conventional waterproof work, liquid water repellents applied to a rooftop all over should be dried for about 2~3 days in order to form a waterproof coating layer. In addition, asphalt should be melt at temperature of about 200~300° C. and dried for several hours after application thereof.

However, in a waterproof structure according to the present invention, a base sheet layer, a hard sheet layer, and a cover sheet layer may comprise a plurality of sheets, and a constructor may form a waterproof structure by arranging base sheets, hard sheets or cover sheets. Alternatively, pre-made base sheets, hard sheets or cover sheets may be prepared before construction to complete a waterproof work promptly.

A rubber-asphalt sheet may be used for the base sheet and the cover sheet and a metal board having a protective coating layer may be used for the hard sheet. For example, a triple waterproof structure in which a rubber asphalt sheet, a hart sheet and a rubber asphalt sheet are overlaid in order may be formed on a base surface of a rooftop. The triple waterproof structure is advantageous to prevent water leakage caused by cracks resulted from behavior of a concrete slab and/or caused by planting in the upper side. Also, the triple waterproof structure is effective in improving operation efficiency through an entire dry waterproof method. Furthermore, it is possible to achieve high-quality waterproof effects with a little notice and awareness of know-how, since each layer may be formed by arranging pre-made sheets regularly.

According to one embodiment of the present invention for achieving the aforementioned objects, a prefab waterproof structure comprises a base sheet layer including a plurality of base sheets spread on a base surface of a building structure, a hard sheet layer including a plurality of hard sheets, a first waterproof tape attached over the joint region of hard sheets, and a second waterproof tape attached over the first waterproof tape. The base sheet layer and the hard sheet layer may form an orderly overlaid structure. Alternatively, the sheets of the sheet layers may be regularly arranged to form a waterproof or protective membrane respectively.

In a waterproof structure according to the present invention, a base sheet layer and a hard sheet layer may comprise a plurality of sheets. A constructor arranges pre-made base sheets or hard sheets in order before construction and can prepare the base sheet layer and the hard sheet layer easily without high skills.

A rubber asphalt sheet may be used for the base sheet and a metal board, a PVC (poly vinyl chloride) board or a paper board may be used for the hard sheet. The metal, PVC or paper board may have a protective-coating applied thereon, wherein the protective coating section may have characteristics of corrosion resistance, toughness, and chemical resistance as well as waterproofing, wherein the protective coating may have a painted layer, a Co-polyester layer and R-polyester layer overlaid in order.

A binding tape is attached over the joint region of hard sheets to connect the hard sheets firmly. Further, since the binding tape may be formed using elastic acryl, the binding tape not only can shrink or expand according to the shrinking or expanding of the adjacent hard sheets and protect the joint region, but also can prevent water leakage by filling up the gap with the self-restoring force.

A first waterproof tape is attached over the binding tape. The first waterproof tape may at least partially enclose the binding tape to protect the binding tape. Alternatively, when the first waterproof tape encloses the binding tape, an invasion route of water may be extended to improve efficiency of prevention of water leakage. According to occasions, a second or a third waterproof tape may be attached over and over to protect the joint region and improve efficiency of waterproofing.

Furthermore, efficiency of waterproofing may be more improved by interposing sealing material such as hydrophilic rubber, silicone rubber and the likes between the adjacent hard sheets before attaching the binding tape. For example, hydrophilic sealing material can absorb behavior resulted from shrinking/expanding of hard sheets and prevent water leakage therein.

BRIEF DESCRIPTION OF THE DRAWINGS

The above and other features and advantages of the present invention will become readily apparent by reference to the following detailed description when considered in conjunction with the accompanying drawings wherein.

DESCRIPTION OF THE INVENTION

Figure 1:
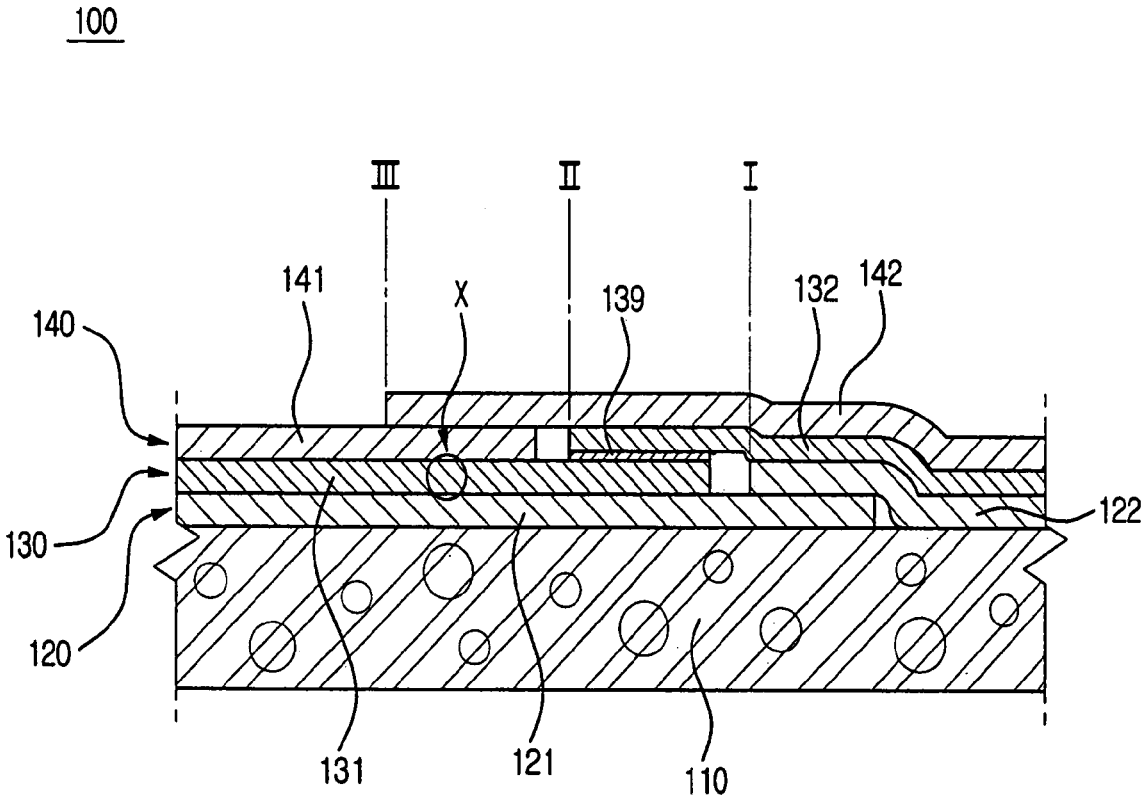
FIG. 1 is a sectional view illustrating a prefab waterproof structure and method for fabricating the waterproof structure according to one embodiment of the present invention.

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like reference numerals refer to similar or identical elements throughout.

Figure 2:
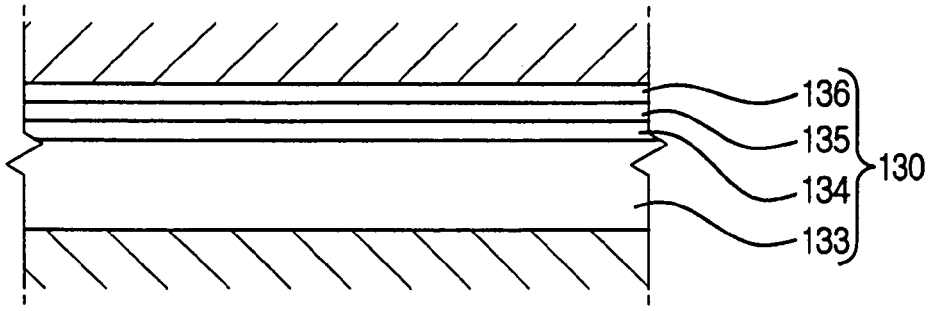
FIG. 2 is an enlarged sectional view illustrating an X section in FIG. 1.

FIG. 1 is a sectional view illustrating a prefab waterproof structure and waterproof method according to one embodiment of the present invention, and FIG. 2 is an enlarged sectional view illustrating an X section of FIG. 1.

Referring to FIGS. 1 and 2, a prefab waterproof structure 100 has an overlaid structure on a base surface 110 of a building structure, wherein the overlaid structure comprises a base sheet layer 120, a hard sheet layer 130, and a cover sheet layer 140. The base surface 110 may be a concrete slab such as a rooftop, a roof or a wall of a building structure.

The base sheet layer 120 is formed on the base surface 110 of a building structure and base sheets 121 and 122 including rubber asphalt are spread in turn on the clean and/or treated base surface 110. The base sheets 121 and 122 are spread on the base surface 110 about 1000 mm in width and sequentially spread to be about 30~50 mm overlapped.

The joint region I of the base sheets may be closely adhered to each other through thermal bonding. In case hard sheets 131 and 132 are formed of metallic material, there may be scratching on the rear of the hard sheets 131 and 132, whereby the rear of the hard sheets 131 and 132 may be decayed. However, when the base sheets 121 and 122 are closely adhered to the rear of hard sheets 131 and 132, the base sheets 121 and 122 may isolate the rear of the hard sheets 131 and 132 to prevent them from decaying. In addition, anchors and/or disks may fix and fasten the base sheets 121 and 122 on the base surface 110 completely, so to protect the base sheets 121 and 122 against damages caused by wind pressure.

The base sheet layer 120 can simplify treatment of the base surface 110, prevent the hard sheets 131 and 132 from decaying due to scratching, and soften a walking sense by supporting hard sheets 131 and 132 softly.

Furthermore, in case of using the hard sheets 131 and 132 including a metallic plate on the base sheet layer 120, moisture may decay the metallic plate by dewing on the bottom surface of the hard sheets 131 and 132. However, since the base sheets 121 and 122 formed using rubber asphalt sheets are attached closely to the hard sheets 131 and 132, they can prevent the metallic plate from decaying. In addition, the hard sheets 131 and 132 may protect winter damages of the base sheets 121 and 122. It is also true that rubber asphalt formed of a soft material is easy to be affected by the surroundings. However, the hard sheets 131 and 132 also can supplement this weakness of the base sheets 121 and 122, whereby it is possible to achieve more reliable and stable waterproof effects.

The hard sheet layer 130 is formed on the base sheet layer 120, wherein the hard sheet layer 130 comprises a plurality of hard sheets 131 and 132. Each of the hard sheets 131 and 132 includes a flat board 133 and a protective coating section, wherein the protective coating section is a triple structure having a painted layer 134, a Co-polyester film 135, and an R-polyester film 136. The hard sheet layer 130 is overlaid on the base sheet layer 120 arranging the hard sheets 131 and 132 in every direction, and the joint region of the hard sheets 131 and 132 is bound together by an adhesive tape 139.

As aforementioned, in case of using a conventional synthetic high molecular sheet, although waterproof materials have excellent elonagation, tensile strength, and adhesive strength, it may be easily torn or faded by the sunlight, joint regions may be exfoliated or the waterproof structure may be blistered due to moisture contained in the base surface.

Furthermore, in case of using conventional waterproof coating, both organic and inorganic coatings may have a bad hardening level according to amounts of moisture of the base surface of a building structure. Accordingly, there may be problems such as blistering caused by vapor pressure or cracks in a waterproof structure by behavior of concrete. Disclosed is a composite waterproof method using both sheets and coating in order to solve the aforementioned problems. However, problems such cracks, blistering, etc are still unsolved since coefficients of thermal expansion are different among the base surface-sheet-coating.

However, the hard sheets 131 and 132 may be formed of high strength materials and the sheets are not easily damaged against external shocks. For example, when a garden is formed on the waterproof structure, the waterproof structure may have a remarkable durability against the roots of planted trees, whereby the waterproof structure may provide an excellent rooftop greening system.

When heat is added to a polyester film comprising the Co-polyester film 135 and the R-polyester film 136, strong adhesiveness is shown on the Co-polyester film 135. In addition, the heated polyester film is laminated on the painted layer 134, so that it is possible to provide a laminating film having excellent chemical resistance of high gloss and high processing. Furthermore, designs of the hard sheets 131 and 132 may be modified variously by expressing patterns or designs on the laminating film when a printing layer having diverse designs is formed between the Co-polyester film 135 and the painted layer 134.

According to one embodiment of the present invention, it may be possible to use PVC series or other synthetic resin series instead of polyester series for a protective coating section of hard sheets, however, more careful attention should be paid thereto since ecological hormone of PVC series becomes an issue.

Referring to FIG. 1, the hard sheets 131 and 132 are formed to have width of about 1,500-1,650 mm and the joint regions of the hard sheets 131 and 132 are attached over each other about 30 mm in width. The adhesive tape 139 is used for joint regions of the hard sheets 131 and 132. The adhesive tape 139 may couple and unify the hard sheets 131 and 132 which are formed of high-strength materials using acryl and may prevent water leakage adapting to the shrinking/expanding of the hard sheets 131 and 132 with predetermined elasticity. Accordingly, the adhesive tape may protect the base sheet layer 120 of the lower side.

Furthermore, the adhesive tape 139 having a sufficient thickness may have a self-restoring force to effectively protect the hard sheets 131 and 132 against the external shocks. Alternatively, the adhesive tape 139 may fill a gap caused by shrinking of the hard sheets 131 and 132 to prevent any possible water leakage.

The cover sheet layer 140 is formed on the hard sheet layer 130, wherein the cover sheet layer 140 includes cover sheets 141 and 142. The cover sheets 141 and 142 may be formed using rubber asphalt similarly to the base sheets 121 and 122 and overlaid on the hard sheet layer 130.

The base sheet layer 120, the hard sheet layer 130 and the cover sheet layer 140 form a triple waterproof structure on the base surface 110. Since it is possible to assure functions of corrosion resistance, chemical resistance, and toughness required for a waterproof structure of a rooftop greening system, it may be prevented possibility itself of constructive defects of wet materials which are found in conventional inorganic coating or organic coating.

Especially, unlike the conventional waterproof layers, a waterproof structure having the base sheet layer 120 and the hard sheet layer 130 may positively prevent damages of the waterproof structure due to the cracks resulted from behavior of a concrete slab and damages of the water structure caused by roots of plants.

Figure 3:
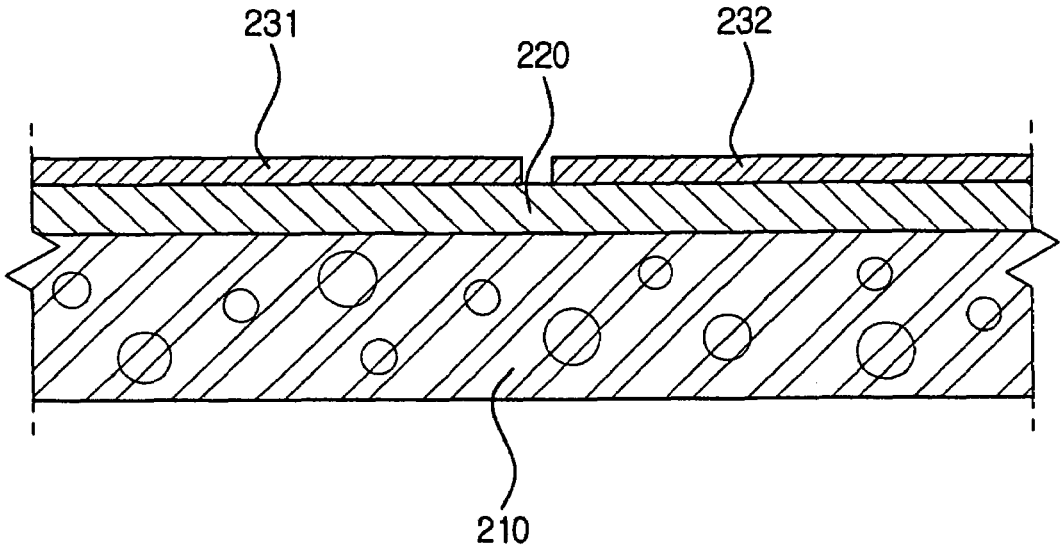
FIG. 3 and FIG. 4 are sectional views illustrating a prefab waterproof structure and waterproof method according to one embodiment of the present invention.
Figure 4:
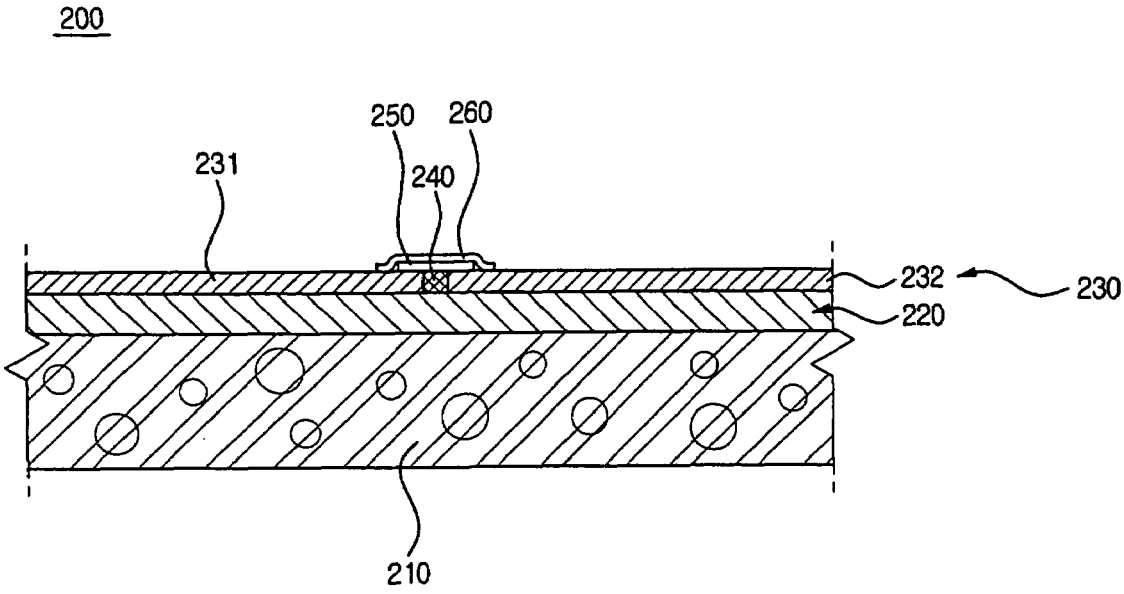

FIG. 3 and FIG. 4 are sectional views illustrating a prefab waterproof structure and waterproof method according to one embodiment of the present invention.

Referring to FIGS. 3 and 4, a prefab waterproof structure 200 forms an overlaid structure on a base surface 210 of a building structure, wherein the overlaid structure comprises a base sheet layer 220, a hard sheet layer 230, hydrophilic sealing material 240, an adhesive tape 250 and a first waterproof tape 260. The base surface 210 may be formed using a concrete slab such as a rooftop, a roof, a wall and the likes.

The base sheet layer 220 is formed on the base surface 210 and base sheets including rubber asphalt are spread in turn on the clean and/or treated base surface 210 of a building structure. The base sheets are spread on the base surface 210 about 1,000 mm in width and sequentially spread in order to be about 30~50 mm overlapped. The joint region of the base sheets is closely adhered to each other through thermal bonding.

The hard sheet layer 230 includes hard sheets 231 and 232 overlaid on the base sheet layer 230, wherein the hard sheets 231 and 232 may be formed using rigid material such as metal, synthetic resin, paper and the likes of a high strength. In case the hard sheets 231 and 232 are formed of metallic material, there may be scratching on the rear of hard sheets 231 and 232, whereby the rear of hard sheets 231, 232 may be decayed. However, the base sheets are closely adhered to the rear of the hard sheets 231 and 232 to isolate them from contacts with air or water, so that it is possible to prevent the rear of the hard sheets 231 and 232 from decaying. In addition, anchors and/or disks may fix and fasten the base sheets 121 and 122 on the base surface 110 completely, so to protect the base sheets 121 and 122 against damages caused by wind pressure.

Furthermore, in case of using the hard sheets 231 and 232 including a metallic plate on the base sheet layer 220, moisture may decay the metallic plate by dewing in the lower part of the hard sheets 231 and 232. However, since base sheets formed using rubber asphalt sheets are attached closely to the hard sheets 231 and 232, they may prevent the metallic plate from decaying. In addition, the hard sheets 231 and 232 forming a primary waterproof layer can protect winter damages of base sheets. It is also true that rubber asphalt formed of a soft material is easy to be affected by the surroundings. However, the hard sheets 231 and 232 also may supplement this weakness of the base sheets 121 and 122, whereby it is possible to achieve more reliable and stable waterproof effects.

The hard sheet layer 230 is formed on the base sheet layer 220, wherein the hard sheet layer 230 comprises a plurality of hard sheets 231 and 232. The hard sheets 231 and 232 comprise the flat board 133 and the protective coating section, wherein the protective coating section is a triple structure formed of a painted. layer 234, a Co-polyester film 235, and an R-polyester film 236. The hard sheet layer 230 is overlaid on the base sheet layer 220 arranging the hard sheets 231 and 232 in every direction, and the joint regions of the hard sheets 131 and 132 are apart at predetermined intervals.

As explained in FIG. 2, each of the hard sheets 231 and 232 according to one embodiment includes the flat board 133 comprising a metallic plate, PVC or a paper, wherein the painted layer 234, non-crystallized Co-polyester film 235 and the crystallized R-polyester film 236 are overlaid on the flat board 133 in order. The flat board 133 may not be easily damaged by the external shocks on the waterproof layer during the process of construction because the flat board 133 is formed of high strength material.

If heat is added to a polyester film comprising the Co-polyester film 135 and the R-polyester film 136, strong adhesiveness is shown on the area of the Co-polyester film 135 and if the painted layer 134 of specially manufactured polyester series is laminated, it is changed into a laminating film having excellent chemical resistance of high gloss and high processing. In this embodiment, since the laminating film is exposed to the outside, the laminating film of polyester series having the characteristics of stability is suitable for protective coating section of the hard sheets 231 and 232.

Furthermore, designs of the hard sheets 131 and 132 may be modified variously by expressing patterns or designs on the laminating film. At this time, it may be possible to express diverse designs by forming a printing layer between the Co-polyester film 135 and the painted layer 134.

The hard sheets 231 and 232 may be formed into diverse sizes and diverse shapes, and variously modified according to the shape or use of the base surface 210 of a building structure.

After arranging the hard sheets 231 and 232, sealing material may be interposed between the hard sheets 231 and 232. The sealing material interposed the hard sheets 231 and 232 may protect the joint regions of the hard sheets 231 and 232 from external shock or abrasion, and may prevent unexpected water leakage. The sealing material may be formed using rubber such as hydrophilic rubber, silicone rubber and the likes. In FIG. 4, a hydrophilic sealing material 240 is interposed between the hard sheets 231 and 232 after arranging hard sheets 231 and 232.

Since the hydrophilic sealing material 240 is for protecting joint regions of the hard sheets 231 and 232 against the external shocks or the abrasion, there may be some effects in stabilizing shapes of the hard sheets 231 and 232, protecting shocks, and softening shocks caused by expansion of the hard sheets 231 and 232. In addition, although the binding tape 250 and the first waterproof tape 260 are damaged, it may be possible to prevent water from permeating between the hard sheets 231 and 232. Primarily, the hydrophilic sealing material 240 may prevent an inflow of water by using characteristics of rubber elasticity. Secondarily, since it has a feature of self-expanding the volume in case of contacting water, the hydrophilic sealing material 240 may prevent an inflow of water by self-expanding and completely sealing tightly the space between the hard sheets 231 and 232.

After interposing the hydrophilic sealing material 240 into the joint regions of the hard sheets 231 and 232, the binding tape 250 is attached over the joint regions of the hydrophilic sealing material 240. The binding tape 250 may be formed of acryl form materials having characteristics of elasticity. The binding tape 250 may not only absorb behavior of the hard sheets 231 and 232 and protect the joint regions between the hard sheets 231 and 232 by adapting according to the shrinking/expanding of the adjacent hard sheets 231 and 232 as illustrated, but also prevent water leakage between the hard sheets 231 and 232 by filling up the gap with self-expanding.

The first waterproof tape 260 is attached over the binding tape 250. The first waterproof tape 260 may protect the binding tape 250 by enclosing the binding tape 250 and improve efficiency of prevention of water leakage by extending an invasion route of water. In addition, the first waterproof tape 260 may absorb external transformation like the binding tape 250 and improve durability for repetitive loads.

One waterproof structure 200 comprises the base sheet layer 220, the hard sheet layer 230, the hydrophilic sealing material 240 and the first waterproof tape 260.

In this embodiment, the waterproof structure 200 is a little different from the waterproof structure 100. For example, the hard sheet layer 230 is exposed to the outside and the protective coating section is coated on the upper side of the hard sheets 231 and 232 for durability, chemical resistance, etc against the severe external surroundings. This follows a dry process that may structurally prevent the possibility itself of construction defects of wet materials which is found in conventional inorganic coating or organic coating.

Hereinafter, a prefab waterproof method will be in detail described.

Before forming the waterproof structure 200 on the base surface 210 of a building structure, projecting parts thereon are removed and the base surface 210 of a building structure is cleaned and/or treated using chemical materials not to have any dirty substance. The base sheet layer 220 is formed by spreading base sheets on the tidily cleaned base surface 210 of a building structure. Base sheets are formed about 1000 mm in width, arranged side by side in order to be about 30 mm overlapped, and overlaid in order, thereby covering the rooftop surface.

Base sheets are closely adhered to the base surface 210 by adding heat and pressure to the base sheets, and the base sheets including rubber asphalt are closely adhered to each other around joint regions thereof.

After forming the base sheet layer 220 by spreading the base sheets on the base surface 210, it is possible to fix joint regions or irregularly projecting parts of base sheets on the base surface 210 using anchors and disks.

After forming the base sheet layer 220, the hard sheet layer 230 is formed thereon using hard sheets. The laminating film is placed on the upper side of the hard sheet layer 230. At this time, the hard sheets are arranged in order to be apart at predetermined intervals and hydrophilic sealing material 240 is interposed between the hard sheets. The hydrophilic sealing material 240 may be overlaid on the base sheet layer 220 with hard sheets, arranging the same.

After forming the hard sheet layer 230, the binding tape 250 is attached over and along joint regions of the hard sheets and the hydrophilic sealing material 240. After attaching the binding tape 250, the first waterproof tape 260 is attached thereon.

Like this, a waterproof method according to one embodiment employs a dry process which laminates by replacing inorganic coating with a high molecular substance film, spreads prepared base sheets and hard sheets on the field immediately, and performs the joints thereof on the field. Furthermore, defects caused by the multi-processes are basically prevented by reducing the entire processes. In addition, processes are facilitated remarkably. Accordingly, even an operator without high skills may perform waterproof work easily.

Figure 5:
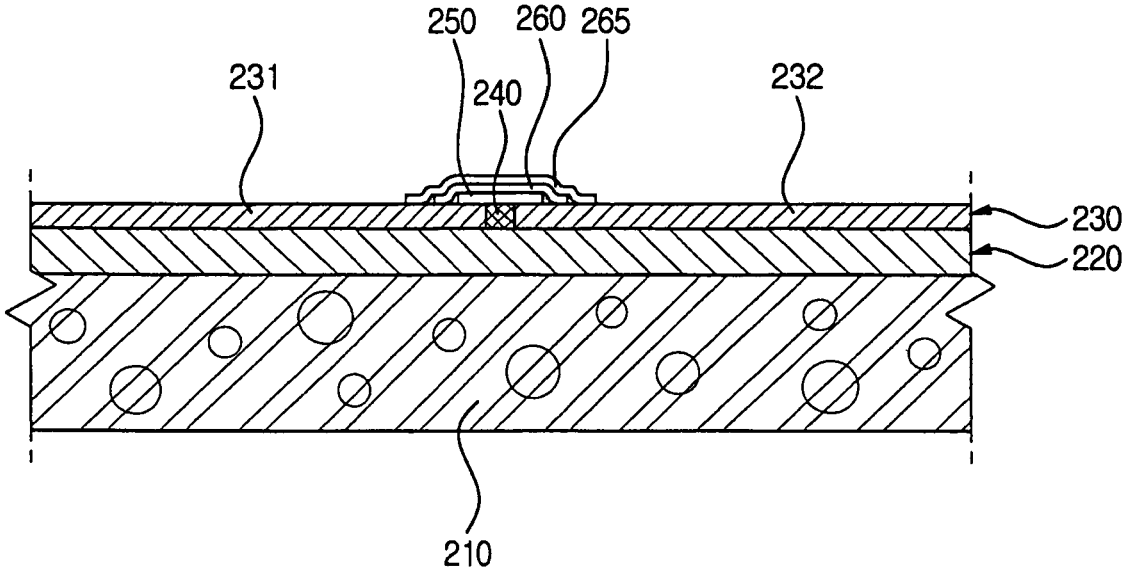
FIG. 5 is a sectional view illustrating a prefab waterproof structure and waterproof method according to one embodiment of the present invention.

FIG. 5 is a sectional view illustrating a prefab waterproof structure and waterproof method according to one embodiment of the present invention.

Referring to FIG. 5, a second waterproof tape 265 is attached over the first waterproof tape 260. The first waterproof tape 260 is for supplementing the joint regions of hard sheets and the second waterproof tape 265 is for unifying the entire waterproof layer. Accordingly, the tapes have a function of a finishing tape which improves durability of a waterproof structure.

Of course, the second waterproof tape 265 has a function of preventing the inflow of water more strictly by extending a traveling route of water.

A waterproof structure according to the present invention for improving durability of a building structure performs a waterproof work immediately and does not require hardening time by using a dry process.

Further, it is possible to prevent environmental pollution by recycling industrial by-products and waste materials such as rubber asphalt sheets, films of polyester series, etc.

Furthermore, since a waterproof method itself does not rely on a constructor's skill, a general operator with concise instructions, know-how and experience also may complete a good quality waterproof work without defect and maintain the quality of construction uniformly.

Furthermore, the present invention is conceived to solve all the problems such as water leakage and inefficiency of an operation, etc that are found in the existing waterproof structure and waterproof method used in a rooftop greening system. Accordingly, the present invention may prevent water leakage caused by cracks resulted from behavior of a concrete slab forming a rooftop floor and may prevent water leakage that is causable in a waterproofing layer by planting thereon.

What is claimed is:

1. A prefab waterproofing method comprising:

forming a base sheet layer having a plurality of base sheets on a base surface of a building structure, the base sheets mutually and partially overlapped;

forming a hard sheet layer having a plurality of hard sheets on the base sheet layer, each of the hard sheets including a flat board and a laminating film pre-formed on the flat board;

attaching a binding tape over the joint regions of the hard sheets;

attaching a first waterproof tape to the binding tape along the joint regions of the hard sheets; and wherein the laminating film includes a painted layer formed on the flat board, a Co-polyester layer formed on the painted layer and a R-polyester layer formed on the Co-polyester layer, wherein the hard sheets coated with the laminating film are overlapped on the base sheet layer.

2. The method as claimed in claim 1, wherein rubber asphalt sheets are used for the base sheets.

3. The method as claimed in claim 2, wherein the joint regions of the rubber asphalt sheets are bound by a melting bond.

4. The method as claimed in claim 1, further comprising interposing a hydrophilic sealing material between the hard sheets in the joint regions of the hard sheet.

5. The method as claimed in claim 1, further comprising attaching a second waterproof tape over the first waterproof tape along the joint regions of the hard sheets.

* * * * *